US007992502B1

(12) United States Patent
Davis

(10) Patent No.: US 7,992,502 B1
(45) Date of Patent: Aug. 9, 2011

(54) INFLATABLE LAPTOP DESK

(76) Inventor: Robert Davis, Fort Myers, FL (US)

( * ) Notice: Subject to any disclaimer, the term of this patent is extended or adjusted under 35 U.S.C. 154(b) by 0 days.

(21) Appl. No.: 12/592,300

(22) Filed: Nov. 23, 2009

Related U.S. Application Data

(60) Provisional application No. 61/199,956, filed on Nov. 21, 2008.

(51) Int. Cl.
*A47B 23/00* (2006.01)

(52) U.S. Cl. ..... 108/43; 108/44; 248/444

(58) Field of Classification Search ..... 108/43, 108/42, 44, 25; 248/444, 454; 206/522, 206/557, 562, 523
See application file for complete search history.

(56) References Cited

U.S. PATENT DOCUMENTS 4,052,944 A * 10/1977 Jennings ..... 108/43
4,537,646 A * 8/1985 Hoyle ..... 248/444
4,700,634 A * 10/1987 Mills et al. ..... 108/43
4,967,992 A * 11/1990 Menaged ..... 248/454
5,005,702 A * 4/1991 Davis et al. ..... 108/43
5,081,936 A * 1/1992 Drieling ..... 108/43
5,134,930 A * 8/1992 Mei-Hwa ..... 108/43
5,623,869 A * 4/1997 Moss et al. ..... 108/43
5,732,849 A * 3/1998 Brooks ..... 220/603
D398,914 S * 9/1998 Pulver ..... D14/447
6,050,200 A * 4/2000 Sullins et al. ..... 108/43
6,374,751 B1 * 4/2002 With ..... 108/43
7,275,724 B1 * 10/2007 Ward ..... 108/43

* cited by examiner

*Primary Examiner* — José V Chen

(74) *Attorney, Agent, or Firm* — William E. Noonan

(57) ABSTRACT

An inflatable laptop desk includes an inflatable base and a horizontal platform mounted to the base for supporting a laptop computer or other device. The base includes one or more valves that allow the base to be selectively inflated for mounting upon a user's lap and deflated for transportation and storage. An optional storage case may be incorporated into the desk.

11 Claims, 3 Drawing Sheets

INFLATABLE LAPTOP DESK

RELATED APPLICATION

This application claims the benefit of U.S. Provisional Patent Application Ser. No. 61/199,956 filed Nov. 21, 2008.

FIELD OF THE INVENTION

This invention relates to an inflatable laptop desk that provides for improved ergonomic support of laptop computers and other items.

BACKGROUND OF THE INVENTION

Laptop personal computers are presently in widespread use. When such computers are utilized in the workplace or at home, they are typically supported upon a desk, table or other substantially horizontal surface. Nonetheless, these devices are specifically designed to be conveniently transportable. It is common for laptop computers to be operated while the user is traveling, such as on an airplane, bus, train, subway, etc. Laptop computers are also frequently used by passengers in motor vehicles.

Conventionally, when a laptop computer is used during travel, it is typically opened and rested directly upon the user's lap. This tends to be ergonomically awkward. The keys of the computer can be difficult to reach comfortably and the screen is apt to be improperly positioned for clear and convenient viewing.

During airplane flights and other forms of travel, laptop computers are commonly supported on the open tray table attached to the seat directly in front of the user. This again tends to result in awkward and difficult to access positioning. As with direct laptop mounting, tray table mounting features poor ergonomics. The user must usually tilt his or her head forwardly and bend his or her neck. This results in extremely poor posture which can increase stress on the spine, as well as the muscles of the neck and back. Over extended periods, this can cause chronic neck and back problems. The stress and strain frequently associated with working on a laptop computer also tends to result in much lower computer productivity and efficiency. At a minimum, the awkward positioning typically required to operate a conventionally supported laptop computer is apt to cause serious discomfort to the user of the device.

Many laptop computers also tend to become quite warm or even hot when operated for lengthy periods. This too can be uncomfortable for the user who rests the computer directly on his or her lap.

SUMMARY OF THE INVENTION

It is therefore an object of the present invention to provide an ergonomically improved inflatable laptop desk that is especially suited for supporting a laptop personal computer on a user's lap so that the computer may be operated in a comfortable and more productive manner.

It is a further object of this invention to provide an inflatable laptop desk that significantly improves the posture of a person using a laptop computer or similarly supported item and which thereby reduces the stress, strain and resulting injuries often caused by known techniques for supporting laptop computers, especially during travel.

It is a further object of this invention to provide an inflatable laptop desk that is conveniently and compactly transportable and storable and which is especially adapted to be used during travel.

It is a further object of this invention to provide an inflatable laptop desk that stably and ergonomically supports a laptop computer or similar item so that the user may conveniently operate the computer while traveling as a passenger on an airplane, train, bus, subway, motor vehicle, etc.

It is a further object of this invention to provide a laptop desk that allows the user to operate a personal computer while traveling in a much more comfortable, productive and injury free manner than has heretofore been possible.

It is a further object of this invention to provide a laptop desk that may be selectively assembled and disassembled, as required, in a quick and convenient manner.

It is a further object of this invention to provide a laptop desk that allows the user of a personal computer to avoid having to awkwardly and uncomfortably bend his or her neck in order to properly view the screen of the computer.

It is a further object of this invention to provide a laptop desk that supports a laptop computer at a comfortable angle that reduces stress on the user's wrists and resulting wrist pain.

It is a further object of this invention to provide an inflatable laptop desk that is extremely durable and capable of being reused numerous times.

It is a further object of this invention to provide an inflatable foam laptop desk that may be quickly and conveniently inflated using either a self-inflating valve or a battery operated pump and easily deflated by squeezing, sitting upon or otherwise pressing the inflated foam.

It is a further object of this invention to provide a laptop desk that utilizes a heat insulating foam and an upper supportive platform to shield the user from the heat typically generated by a laptop computer.

It is a further object of this invention to provide a laptop desk that is effective and convenient for use supporting laptop computers and other devices in a wide variety of environments including the workplace, home and while traveling.

This invention results from a realization that an ergonomically improved inflatable laptop desk, which is especially suited for supporting personal computers during travel, may be achieved by mounting a relatively rigid supportive platform upon an inflatable base that is comfortably supported upon the user's lap in an inflated condition. Such a structure supports the laptop computer in an ergonomically comfortable position during travel so that the keys of the computer are easily accessed and the screen of the computer can be conveniently viewed by the user without unduly bending and possibly straining the neck and wrists.

This invention features an inflatable laptop desk suited for supporting a laptop computer or a similar item upon a user's lap. The desk includes an inflatable base having one or more valves for selectively introducing air into the base to inflate the base and removing air from the base to deflate the base. The base includes a bottom surface for engaging the user's lap, an opposite upper surface that is attached to a bottom of a platform and a side portion that interconnects the bottom and upper surfaces. When the base inflates, the side portion expands so that the upper surface and support platform are raised relative to the bottom surface of the base. Conversely, when the base is deflated, the side portion collapses so that the upper surface and the bottom surface of the base are drawn toward one another.

In a preferred embodiment, the base includes a self-inflating foam core element, which is enclosed within an air-impermeable outer cover. Typically the platform is juxtaposed against an upper surface of the foam element and is likewise enclosed by the air-impermeable cover. An inflating valve is formed through the cover and in communication with the foam core. When the base is in a deflated condition, the foam core is compressed. To inflate the base, the inflating valve is opened such that air is drawn inwardly through the valve to expand the foam core. When the core is in a fully expanded condition, the base is inflated. The valve is then closed to hold the base in an inflated condition. The platform is thereby held in an ergonomically acceptable position to support a laptop computer thereon. Subsequently, when use of the computer is completed, the computer is closed and the base is deflated. This is accomplished by opening the valve and manually squeezing or compressing the foam core to discharge air from the interior of the base outwardly through the inflating valve. After the base is collapsed, the valve is again closed to hold the base in a collapsed condition. This facilitates storage and transport of the desk.

In alternative embodiments, the desk may include separate and distinct valves for respectively inflating and deflating the foam core. In still other embodiments of this invention, the base may be selectively inflated and deflated by a battery operated air pump. The pump may be mounted in or to the support platform and communicably connected to the base. In such cases, the base may include either an air bladder or a foam core and impermeable exterior cover as previously described.

The foam element may have a wedge-shaped or tapered configuration such that the upper and lower surfaces are oriented at an acute angle relative to one another. Alternatively the upper and lower surfaces of the foam element may be substantially parallel to one another.

A storage case, for accommodating a laptop computer or other supported item, may be attached to the base, and more specifically, may be directly secured to the cover. The storage case may include a lower case section formed attached to the cover and an upper case section hingedly attached to the lower section. The upper and lower sections may have generally conforming configurations. When the case sections close, they define a storage compartment. Preferably, the upper and lower sections are selectively joined in the closed condition by a peripheral zipper. The zipper may be opened to allow the upper section to hingedly open relative to the lower section of the case. This permits an enclosed laptop computer to be opened and operated while remaining supported on the platform. The base is selectively inflated to assemble the desk for use and deflated to collapse into the desk for transportation or storage.

DETAILED DESCRIPTION OF PREFERRED EMBODIMENTS

Other objects, features and advantages will occur from the following description of a preferred embodiment and the accompanying drawings, in which.

Figure 1:
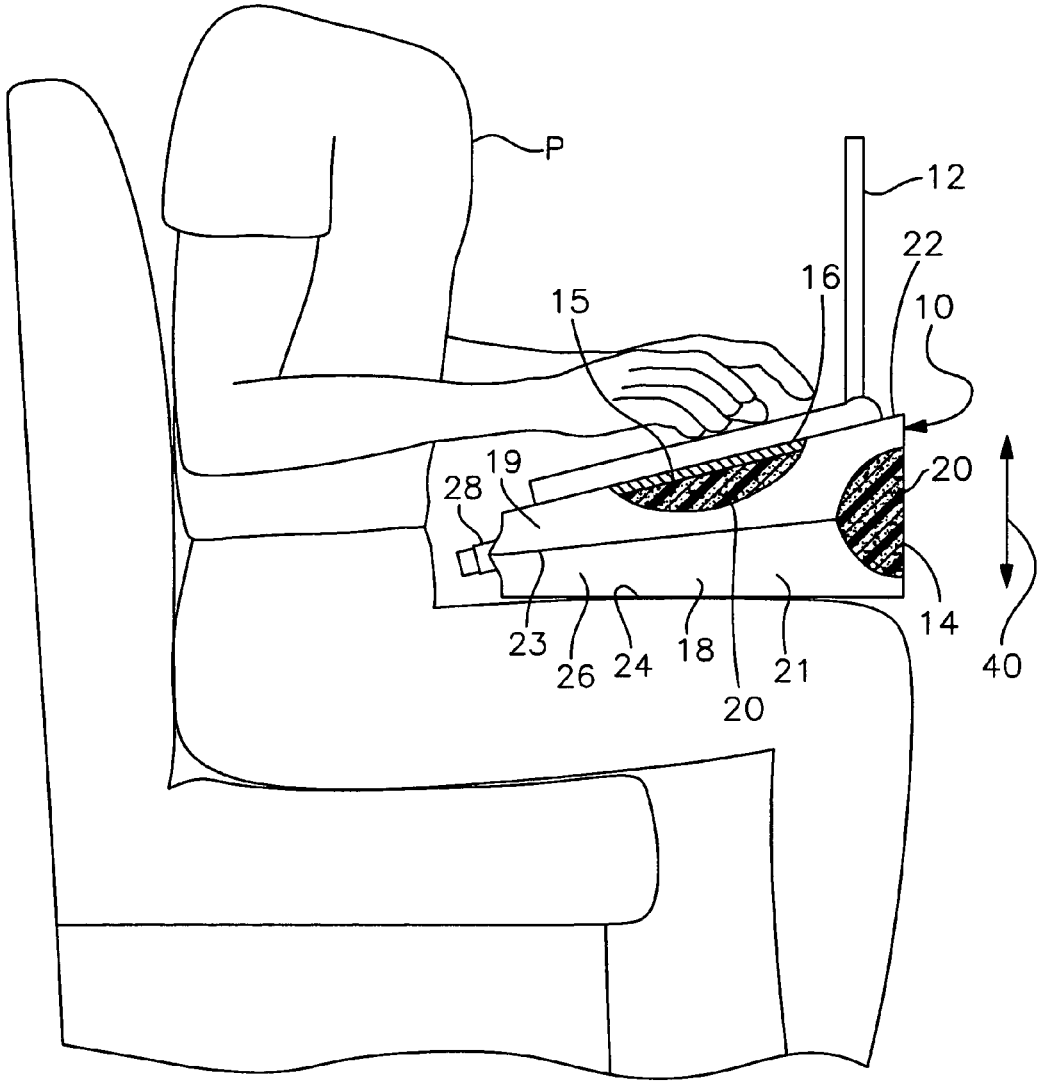
FIG. 1 is a side elevational and partly cut away view of a preferred inflatable laptop desk according to this invention, which is shown supporting a laptop computer upon a user's lap during travel.

There is shown in FIG. 1 an inflatable laptop desk 10 positioned on the lap of a seated person P and supporting a laptop personal computer 12. Desk 10 thereby allows person P to comfortably position and use the computer on his or her lap during travel or at other (e.g. home/office) locations. It should be noted that desk 10 is especially adapted and convenient for use during travel due to its ergonomic construction and its height adjustability and easy collapsibility. It is especially convenient for use by passengers on airplanes, buses, trains and subways, and in motor vehicles. In such venues, the desk is typically placed in an inflated condition upon the user's lap. The laptop computer is then supported on the desk. Alternatively, in home or workplace applications, the inflatable desk may be supported on a desktop, table, airplane tray table or other substantially flat, horizontal work surface. The particular locations and venues in which desk 10 may be employed are not limitations of this invention.

Figure 2:
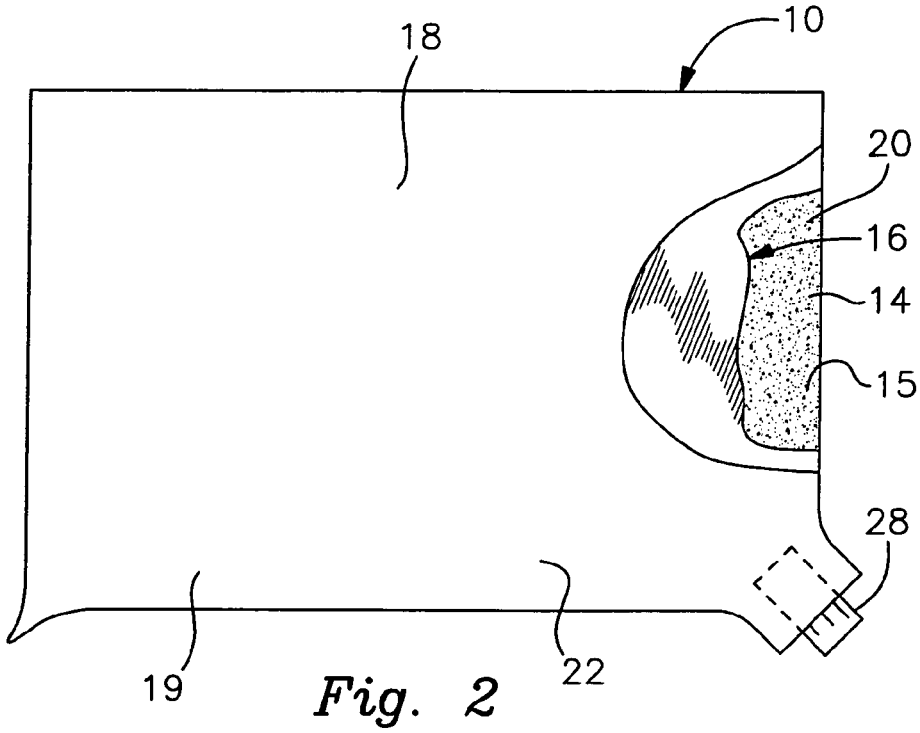
FIG. 2 is a plan view of the support platform of the desk.
Figure 3:
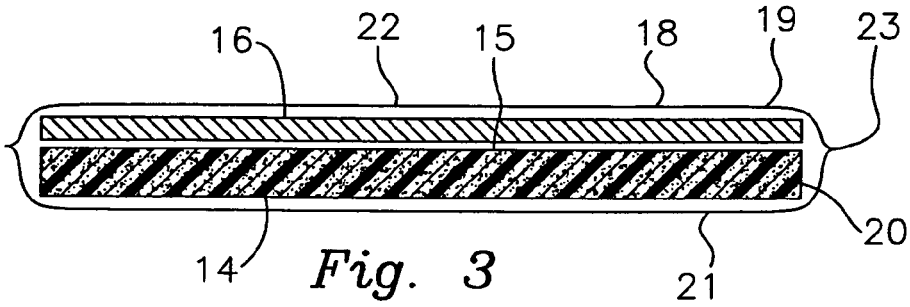
FIG. 3 is an elevational, cross sectional front view of the inflatable desk in a collapsed or deflated condition.

As shown in FIGS. 1-3, desk 10 includes an inflatable base 14 and a relatively rigid platform 16 that is held by base 14 to form a supportive surface of the desk. The preferred manner in which platform 16 is mounted within base 14 is described below. The base itself comprises an outer cover or casing 18 composed of a durable sheet-like material that is impermeable to the passage of air. Various types of synthetic material or tightly woven fabric may be employed. Cover 18 may be either elastomeric or nonstretchable. It may comprise upper and lower cover sections 19 and 21 respectively that are joined along seam 23 (see also FIG. 4) by stitching, heat welding or other known means. Alternatively, the cover may be constructed from a single unitary piece of material. The cover thereby effectively forms an inflatable bladder that is selectively inflated and deflated in the manner described more fully below. Cover 18 may feature assorted patterns, designs and/or colors. The platform may comprise a strong and durable, yet preferably lightweight material. Plastics are typically utilized, although various other materials including wood, metals and other rigid compositions may also be used.

Cover 18 encloses and fits closely about an open cell, self-inflating foam core 20. Polyurethane foam or analogous materials such as are used in inflatable camping mattresses and the like may be utilized in core 20. The foam core should be sufficiently soft and resilient so that the desk is comfortable when supported on a user's lap. By the same token, the foam core should exhibit structural integrity sufficient to securely support a laptop computer 12 or other item at a selected height over repeated reuses. It is also important that the core 20 and base 14 support computer 12 at a height that is comfortable and ergonomic for the user. Preferably a heat insulating foam should be utilized. This helps to shield and protect the user from the heat generated by the laptop computer supported on platform 16.

Figure 4:
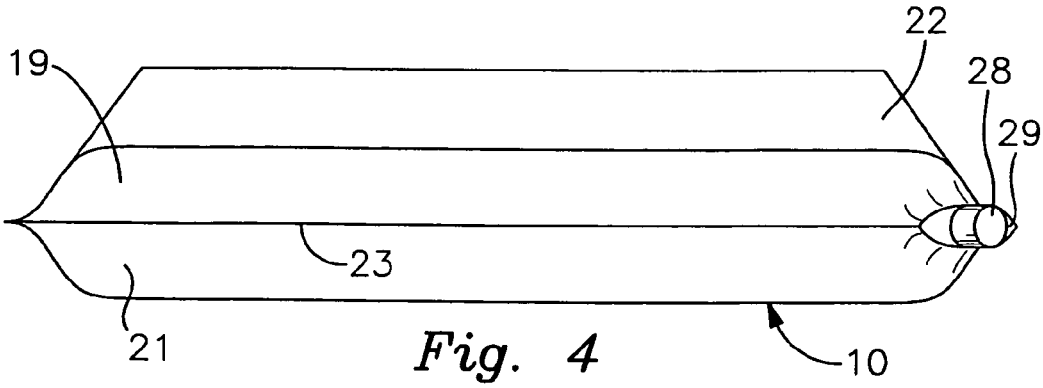
FIG. 4 is a front elevational view of a version of the desk in an inflated condition.

Cover 18 of inflatable base 14 includes opposing upper and lower surfaces 22 and 24 respectively, which are connected by a side section 26. The cover thereby forms an interior space that is filled more or less conformably by foam core 20. Preferably, foam core 12 and conformably enclosing cover 18 are cut or otherwise manufactured to have a tapered or wedge-shaped configuration, as shown in FIGS. 1 and 4, when the base is fully inflated. Upper surface 22 is inclined at an angle of approximately 10 degrees to lower surface 24. Other acute angle may be formed within the scope of this invention. In still other embodiments, the base may have a substantially rectilinear shape wherein the upper and lower surfaces are generally parallel to one another. Other alternative shapes may be used.

An inflation valve 28 is formed through side portion 26. Valve 28 extends through cover 18 and the interior end of the valve communicates with foam core 20 in a known manner that permits the enclosed foam core to self-inflate in a fashion exhibited by conventional camping mattresses and the like. Assorted types of known inflation valves may be utilized. The valve is installed through cover 18 and sealed in a conventional fashion to prevent air leaks from the base. For example, valve 28 may extend through an integral or otherwise connected plug 29, which is sealed within seam 23 between upper and lower sections 19, 21 of cover 18. The valve and attached plug may be composed of various plastics or metals. In alternative embodiments, multiple inflation valves may be utilized.

Horizontal platform 16 is enclosed by cover 18 and juxtaposed against upper surface 15 of foam core 20. The platform may be held loosely between the upper surface of cover 18 and the upper surface 15 of foam core 20. Alternatively the platform may be secured to either the overlying cover or the underlying foam core by adhesives, heat welding or other known forms of attachment. As shown in FIGS. 1-3, platform 16 may have a generally rectangular peripheral shape that largely conforms to the peripheral shape of the base. These dimensions may be varied within the scope of this invention.

As shown specifically in FIG. 3, desk 10 may be selectively deflated and collapsed for storage and transportation. In such cases, self-inflating foam core 20 is compressed within cover 18. Air is largely removed from base 14 and the upper and lower surfaces 22 and 24 of cover 18 are drawn together. The process of converting the desk from an inflated to a collapsed condition is described below.

In operation, a user typically transports the desk in the collapsed or deflated condition shown in FIG. 3 to a location where he or she desires to use the desk. For example, this may constitute an airplane seat S (FIG. 1) or analogous travel setting. The person seated in seat S typically carries both inflatable desk 10 and a laptop computer 12 in a suitable carrying case (not shown). Desk 10 is removed from the case in the collapsed condition shown in FIG. 3. Person P then places desk 10 on his or her lap and assembles the desk by simply unscrewing or otherwise opening valve 28 in a known manner. This introduces ambient air through valve 28 into collapsed or compressed foam core 20, which, in turn, self-inflates. The air is drawn into the vacuum or partial vacuum existing within collapsed foam core 20. As shown in FIG. 1, core 20 expands as indicated by doubleheaded arrow 40. In particular, the core rises so that upper surface 22 of cover 18 is pushed upwardly and separates from lower surface 24. The base inflates to attain its manufactured configuration. This raises enclosed platform 16 to a comfortable desired level and angle for use by person P. When the base is fully inflated, valve 28 is closed in a conventional manner so that the base remains inflated while person P uses it to support computer 12. The user places laptop computer 12 upon the upper surface 22 of base 14 such that the computer is securely supported by platform 16 immediately underlying surface 22. The computer is thereby held at a height and angle that are comfortable for the user and that reduce stress and strain on the user's back and neck during use of the computer. Person P does not have to bend his or her neck unduly to view the screen of computer 12. By the same token, the keyboard is held at a comfortable height and angle for accessing and using the keys. Prolonged periods of poor posture and potential back and neck injury are thereby avoided. Undue bending of and strain upon the wrists is also eliminated. The inclined angle of the desk allows the user to operate the computer with his or her wrists in a much straighter condition. It should be understood that the computer may alternatively be placed upon the upper surface of desk 10 just before the base is inflated. Similarly the base of desk 10 may be inflated before the desk is placed on the user's lap.

Desk 10 also effectively shields the user's lap from the heat generated by the laptop computer. This is accomplished at least in part by the innovative foam in base 14. In addition, the feet of computer 12 raise the computer slightly above upper surface 22 and platform 16, which provides a gap for air circulation between the computer and the desk. This further dissipates the heat and contributes to the comfort of the user.

When person P has completed using computer 12, the computer is closed and returned to its carrying case. Desk 10 is then quickly and conveniently collapsed and stored. In particular, person P unscrews or otherwise operates (opens) valve 28 (or a separate deflation valve) and simultaneously squeezes or compresses base 14. This can be accomplished by sitting upon the desk, pressing down upon platform 16 or otherwise squeezing and collapsing foam core 20. Air is thereby discharged from the foam core through valve 28 and base 14 is collapsed into the condition shown in FIG. 3. After the base is deflated through valve 28, the valve is re-closed so that the base continues to be held in a collapsed condition until such time as use of the desk is required. The entire desk can then be conveniently stored with the personal computer in the user's carrying case. Subsequently, the desk can be removed from the case, reinflated and reused, as desired, in the previously described manner.

In alternative versions of this invention, the inflatable desk may feature an inflatable, air impermeable bladder composed of a flexible and optionally resilient, sheet-like material, but wherein a foam core is not utilized. Instead, the bladder encloses an air cavity or chamber that is selectively filled with and discharged of air to inflate and deflate the bladder, respectively. This may be accomplished through the use of a battery operated pump. In such cases, the supportive platform may be secured to an upper surface of the inflatable bladder. Various known types of battery operated pumps, such as those used for aquariums, may be utilized. The pump is typically communicably connected to the bladder. The pump is selectively actuated to introduce air into bladder so that the bladder is inflated. The pump may include a valve that is selectively opened when the pump is deactivated. This discharges air from the previously inflated bladder so that the bladder is collapsed and flattened. Alternatively, the pump may simply be reversed to remove air from bladder and deflate the bladder. Various known types of pumps may be employed to inflate and/or deflate the bladder in accordance with this invention. Otherwise, the desk is inflated and deflated in a manner analogous to that previously described in order to erect and collapse the desk respectively.

Figure 5:
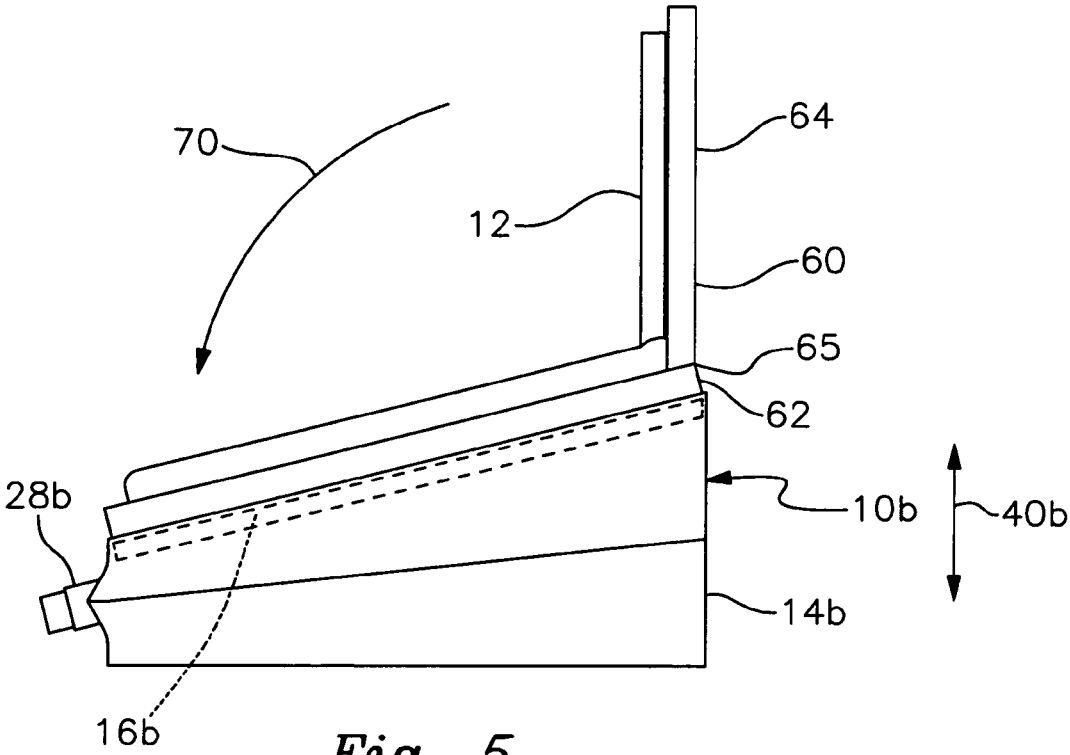
FIG. 5 is an elevational side view of an alternative version of the inflatable laptop desk, which incorporates a laptop computer carrying case; a laptop computer is shown supported on the platform with the case in an open condition.
Figure 6:
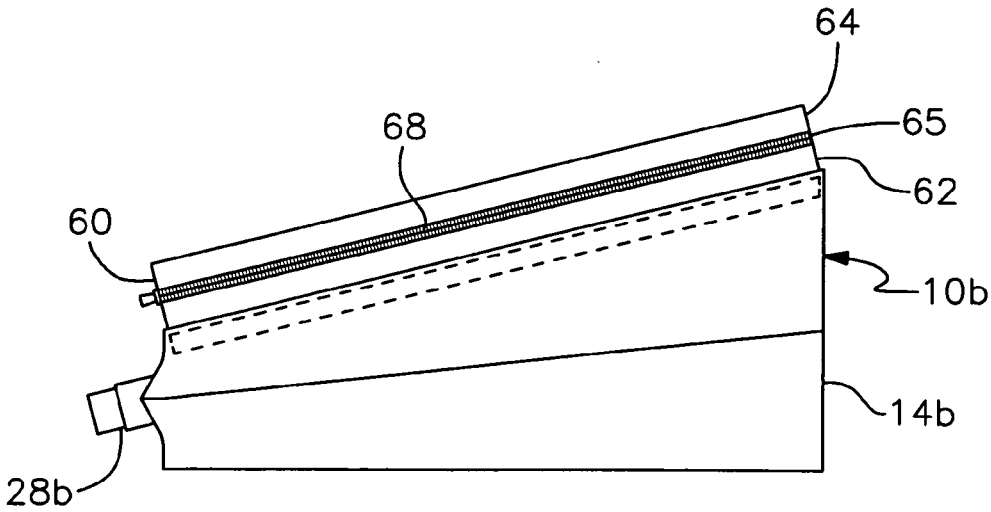
FIG. 6 is an elevational side view of the embodiment of FIG. 5 with the case in a closed condition.

FIGS. 5 and 6 depict an alternative version of this invention wherein desk 10*b* incorporates a carrying case for laptop computer 12. Inflatable desk 10*b* again includes a base 14*b*, which may be constructed and operate identically or similarly to the previously described base 14. In particular, base 14*b* is selectively inflated as indicated by arrow 40*b* to raise an integrated platform 16*b* (shown in phantom in FIG. 5), which, in turn, supports laptop computer 12. The platform is juxtaposed against a top surface of a wedge-shaped open cell foam element and enclosed by an airtight cover in the manner previously described. Alternatively, the platform may be attached exteriorly to an upper surface of base 14*b*.

Desk 10*b* includes an integral storage case 60 attached to base 14*b*. Case 60 particularly includes a lower case section 62 and an upper case section 64 that is hingedly attached to section 62 along joint 65. The lower case section is fastened permanently to upper section 19 of cover 18. Alternatively, when an exterior platform is used, lower case section 62 peripherally surrounds the platform and features a lip that extends upwardly from the platform. In either case, lower section 62 comprises a peripheral rectangular lip for receiving and surrounding the bottom (e.g. keyboard) of laptop computer 12. Case section 64 opposes and generally conforms to the shape of lower section 62 and includes a flat top (not shown) and a peripheral lip 65, which depends from the flat top. The case sections 62 and 64 typically comprise a fabric material. A similar fabric may enclose base 14*b* and be stitched or otherwise interconnected to lower case section 62. Each of the case sections 62 and 64 includes a lip for peripherally surrounding enclosed computer 12. The peripheral lip of lower section 62 extends upwardly from base 14*b* and surrounds the keyboard of a computer 12 mounted on the platform of the desk. By the same token, the lip 65 of upper section 64 generally surrounds the screen of the computer. Sections 62 and 64 have complementary generally rectangular shapes that match the shape of the enclosed platform (see FIGS. 1-3). The case sections are foldably or hingedly connected along one edge. The three remaining corresponding edges are selectively joined by a zipper 68, FIG. 6. The zipper is selectively opened to allow the case sections 62 and 64 to unhinge and open as shown in FIG. 5. In that condition, a personal computer 12 is supported on the platform of the desk. Note that in such cases the base 14*b* is inflated. In this condition, the desk is placed on the user's lap and the computer is operated in a desired manner analogous to that previously described.

When use of the computer is completed, the user pivotally closes the screen of computer 12 and then folds case section 64 closed relative to case section 62 in the direction of arrow 70 in FIG. 5. The lower lip edge of section 64 fully engages the upper lip edge of section 62. The upper and lower case sections 62 and 64 are then fully closed by closing zipper 68 as shown in FIG. 6. The opposing case sections 62, 64 have respective interior depths or heights that are large enough to provide case 60, when closed, with ample space to accommodate computer 12. In this manner, the laptop computer is securely stored within case 60. Valve 28*b* or, alternatively, a separate deflation valve is operated to deflate base 14*b* into a condition similar to that depicted for base 14 in FIG. 3. The collapsed base and attached casing are then stored or transported in a convenient manner.

The inflatable desk of this invention provides for secure and ergonomic laptop support for laptop computers and similarly supported devices. The user avoids undue stress and strain to the neck, back and wrists. Chronic physical injuries, pain and discomfort are therefore avoided. Improving the user's comfort also achieves improved productivity and efficiency.

The inflatable desk is assembled and disassembled quickly, conveniently and effortlessly. After the device is deflated, it is extremely compact so that it may be conveniently stored, transported and reassembled as required.

It should be noted that although the desk is particularly effective for use in supporting laptop computers, it may also be used to provide support for various other items and activities in accordance with this invention. These include, but are not limited to, items such as writing implements, food trays, utensils, cellular telephones, calculators, PDA's and DVD players, and activities such as writing, eating and playing board/computer games. In all cases, the item, device or activity is supported at an ergonomically desirable height, angle and position which reduces physical stress and strain and improves worker productivity and efficiency. The desk may also be used effectively on desktops, tables and other horizontal surfaces.

The inflatable laptop desk of this invention may feature various alternative shapes and dimensions. For example, the upper surface of the desk defined by platform 16 may have a side-to-side length of 35 cm and a top-to-bottom width of 27 cm. In such embodiments, the side section 26, in an inflated condition, has a relatively wide or distal height of 10 cm and a relatively short proximal height of 5 cm. As previously indicated, the upper surface of the inflated desk maintains an angle or inclination of approximately 10 degrees relative to the flat bottom surface of the desk.

In an alternative embodiment, the upper surface of the desk defined by the platform has a side-to-side length of 27 cm and a front-to-back width 19 cm. The distal and proximal heights of the inflated base are 8 cm and 5 cm respectively. The upper surface has an inclination similar to that for the larger version. This comprises a more compact version that is suitable for accommodating smaller portable laptop computers. It should be understood that the dimensions of the desk may be varied within the scope of this invention to provide a desired desktop size and to accommodate various sizes of laptop computers. Various arrangements and placements of valves may be utilized for the desk. The base may have rectilinear and other types of configurations within the scope of this invention. In each of the embodiments, a platform may be mounted either interiorly within the base, as described above, or exteriorly to a top surface of the base.

From the foregoing it may be seen that the apparatus of this invention provides for a laptop desk that provides for improved ergonomic support of laptop computers and other items. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. An inflatable laptop desk for supporting an item on a person's lap, said desk comprising:

an inflatable base including an open cell, resiliently compressible foam core and an air impermeable cover that encloses said foam core, said cover having spaced apart upper and lower surfaces and a side portion that interconnects said upper and lower surfaces, said base being positionable on the person's lap such that said lower surface faces generally toward the person's lap and said upper surface faces generally away from the person's lap;

a valve communicably connected to said base, said valve being formed through said cover and in communication with said foam core for selectively removing air from said base when said foam core is compressed to deflate said base and introducing air into said base to expand said compressed foam core and inflate said base; and a relatively rigid platform carried by said base above said foam core for underlying and supporting the item; said base being selectively inflated to expand said side portion and raise said upper surface and said platform relative to said lower surface and deflated to collapse said side portion and draw said upper surface and said platform toward said lower surface.

2. The apparatus of claim 1 in which said cover encloses said platform such that said platform is juxtaposed against a top surface of said core.

3. The apparatus of claim 1 in which said foam core has a wedge-shape configuration wherein said upper surface is oriented at an acute angle to said lower surface.

4. The apparatus of claim 1 in which said platform includes a flat, rigid panel that is separate and distinct from said foam core and juxtaposed directly against said top surface of said core.

5. The apparatus of claim 1 in which said valve is selectively opened to draw air inwardly therethrough to expand said foam core and inflate said base and alternately to discharge air from the foam core therethrough to collapse said core and deflate said base, said valve being selectively closed to maintain said base in one of the inflated and deflated conditions.

6. The apparatus of claim 1 further including a storage case attached to said cover and including a compartment for storing the item to be supported on said desk therein.

7. The apparatus of claim 6 in which said storage case includes generally conforming upper and lower case sections that are hingedly interconnected.

8. The apparatus of claim 1 in which said cover includes a sheet-like material that conforms to the shape of said foam core.

9. An inflatable laptop desk for supporting an item on a person's lap, said desk comprising:

an inflatable base including a resiliently compressible foam core and an air impermeable cover that encloses said foam core, said cover having spaced apart, opposing upper and lower surfaces and a side section that interconnects said upper and lower surfaces, said base being positionable on the person's lap such that said lower surface faces toward the person's lap and said upper surface faces away from the person's lap;

a valve communicably connected to said base for selectively introducing air into said base to inflate said base and removing air from said base to deflate said base, said valve being formed through said cover and in communication with said foam core; and a relatively rigid platform juxtaposed against a top surface of said core and enclosed by said cover for underlying and supporting the item; said base being selectively inflated to expand said side portion and raise said upper surface and said platform relative to said lower surface and deflated to collapse said side portion and draw said upper surface and said platform toward said lower surface.

10. The apparatus of claim 9 in which said valve is selectively opened to draw air inwardly therethrough to expand said foam core from a compressed condition and inflate said base and alternately to discharge air from said foam core therethrough and deflate said base when said foam core is compressed, said valve being selectively closed to maintain said base in one of the inflated and deflated conditions.

11. The apparatus of claim 9 in which said foam core includes an open cell foam.

* * * * *